United States Patent [19]

Takenouchi et al.

[11] Patent Number: 4,946,404

[45] Date of Patent: Aug. 7, 1990

[54] LOCKING SECURITY MECHANISM OF ELECTRICAL CONNECTOR

[75] Inventors: Kenji Takenouchi; Toshihiko Makita; Mitsuru Matsumoto, all of Shizuoka, Japan

[73] Assignee: Yazaki Corp., Tokyo, Japan

[21] Appl. No.: 350,485

[22] Filed: May 11, 1989

[30] Foreign Application Priority Data

May 13, 1988 [JP] Japan ..... 63-63041[U]

[51] Int. Cl.[5] ..... H01R 13/627

[52] U.S. Cl. ..... 439/352; 439/357

[58] Field of Search ..... 439/345, 347, 350, 351, 439/352, 353, 354, 355, 356, 357, 358

[56] References Cited

U.S. PATENT DOCUMENTS 4,370,013 1/1983 Niitsu et al. ..... 439/352
4,710,135 12/1987 Aoyama et al. ..... 439/354
4,711,511 12/1987 Noorily ..... 439/347

FOREIGN PATENT DOCUMENTS 2801427 7/1978 Fed. Rep. of Germany ..... 439/358
59-29351 8/1984 Japan .

*Primary Examiner*—Neil Abrams
*Assistant Examiner*—Khiem Nguyen
*Attorney, Agent, or Firm*—Armstrong, Nikaido, Marmelstein, Kubovcik & Murray

[57] ABSTRACT

A locking security mechanism for an electrical connector having a pair of male and female connector members, locking arm member with the locking opening and a locking security member mounted in a male connector member in a normally undetachable manner and maintained in a pre-engagement position with a pre-engagement releasing means in a female connector member. When the male and female connector members are engaged with each other, actuating fingers in the female member act on a inclined lower surface of pre-engagement fingers in the locking security member to escape the pre-engagement. Locking arm member with the locking opening in the male member comes into engagement with the locking security member unlocked from the pre-engagement state wherein a means for preventing the locking security member from securing in incomplete locking inlcudes a block member provided at the free end of the locking arm member, an enclosure wall portion provided in the main body of the locking securing member for receiving the block member of the locking arm member, and checking lugs provided in the block member and the enclosure portion for abutting with each other.

17 Claims, 5 Drawing Sheets

LOCKING SECURITY MECHANISM OF ELECTRICAL CONNECTOR

BACKGROUND OF INVENTION

1. Field of the Invention

Present invention relates to an improvement of lock security mechanism of connector to be used for the connection of electric wires or the like.

2. Description of Prior Art

Usual lock security mechanism of electrical connector, such as shown in FIGS. 6 & 7, is provided with a locking arm 3 extending forwardly of the outer wall 1 in a male housing M by means of front upright base 2. A female housing F has a shell 6 receiving the male housing M and having a locking chamber 7 into which the locking arm 3 is inserted. When both housings are engaged with each other, an engaging claw 4 at an end of the locking arm is engaged with a securing hole 8. In this locking state, an unlocking preventing piece 9 is detachably inserted between the outer wall 1 and the locking arm 3 so that the locking state may be prevented from unintentional release. In the drawings, 5 is receiving rooms for terminal fittings not shown. Such arrangement is found in Japanese Utility Model Preliminary (laid-open) Publication No. 59-29351.

Prior art locking security mechanisms as such have an arrangement that the unlocking preventing piece 9 is attached after the male and female housing M, F are engaged with each other. Therefore, it has often occurred that during the engagement operation the insertion of the unlocking preventing piece 9 is omitted and the omission is difficult to be found later. Further, as clearly shown also in the drawings, the unlocking preventing piece 9 may be mounted before the male and female housings M, F are engaged together. In this case, any undesired state that both housings are placed in a incomplete locking position cannot be found easily. Moreover, the unlocking preventing piece 9 which is small and separate from the housing is apt to be released in case of inspection or exchange of the connector. Such a released piece is difficult to be found out in the engine room of a motor-car or the like location if lost.

SUMMARY OF THE INVENTION

The present invention aims to provide an improved lock security mechanism for connectors for completely preventing the locking arm in the housing from any unlocking state by prevention of unintentional release of an unlocking preventing member and for eliminating an incomplete locking state of the connector.

In order to obtain the aim as mentioned, the present invention provides a lock security mechanism for an electrical connector having a pair of male and female connector members, the male member having a plurality of longitudinal compartments receiving terminal fittings and the female member having a rear portion having a plurality of longitudinal compartments similar to those of the male member and a front portion having a chamber for receiving at least a front portion of the male connector member. The locking security mechanism includes lug means provided in one of the male and female connector members, opening means provided in the other of the connector members for receiving the lug means, and locking security means. The locking security means has a locking security member mounted in one of the connector members in a normally undetachable state and maintained in a pre-engagement position in which it is prevented from coming into a position for securing the locking of the locking means. A pre-engagement releasing means is provided in the other of the connector members for making the locking security member capable of coming into the position for securing the locking of the locking means when the connector members engaged. Means are also provided for preventing the locking securing member from coming into securing position when the locking means is placed in an incomplete locking position.

DESCRIPTION OF THE DRAWINGS

The invention, together with additional objects, features and advantages thereof, will be best understood from the following description, the appended claims and the accompanying drawings in which:

FIG. 2A shows a pre-engagement state of the locking security member and FIG. 2B a normal engagement state thereof;

DESCRIPTION

Figure 1:
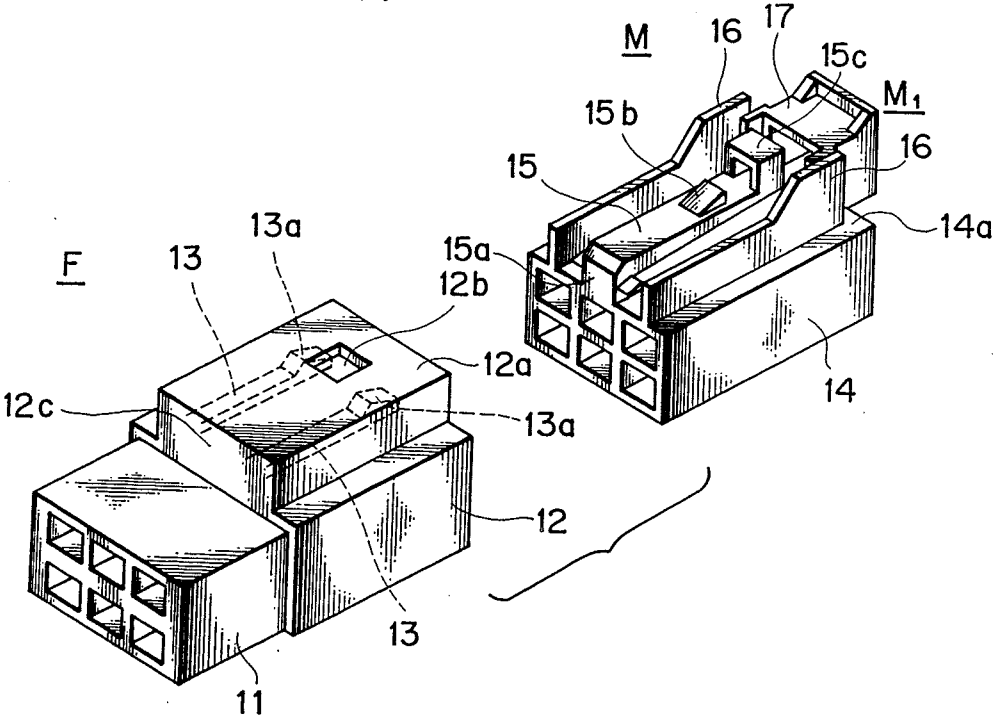
FIG. 1 is a perspective view of a connector equipped with a lock security mechanism in accordance with a preferred first embodiment of the invention in which a male and a female housings are shown in their separate state.

Referring to FIG. 1, a female connector member or housing F of synthetic material or the like has a rear portion 11 of rectangular box shape having six longitudinal compartments receiving terminal fittings (not shown) and a front portion 12 of larger cross section than that of the rear portion 11 which has a rectangular locking opening **12*b* in the upper wall 12*a* higher than that of the rear portion 11. The front portion 12 has a chamber receiving a male connector member or housing M. In the chamber of the front portion 12 are provided two actuating fingers 13, 13 for locking engagement which extend forward from the rear wall 12*c* in a cantilever fashion. The actuating fingers 13, 13 have at the free end an arrowheaded portion 13*a* acting on a locking security member M1**, detachably assembled in the male member M.

The male connector member or housing M also of synthetic material has a rectangular box shape also having six longitudinal compartments connected and aligned with those of the rear portion 11 of the female member F when engaged together. The male member M has an upper wall 14a provided on the upper surface with a locking arm member 15 which has an upright base portion 15a at the front end of the wall 14a and horizontal arm portion 15e connected with the base portion 15a and extending rearward and apart from the upper surface of the wall 14a. The arm portion 15e is provided with a lug 15b at the middle portion of its upper surface. The lug 15b has an inclined forward face and is engaged with the locking opening 12b of the female member F when both are engaged. The locking arm member 15 has an operating portion 15c at the rear and free end of the horizontal arm portion 15e. On both sides of the locking arm member 15 stand vertical protection walls 16, 16 extending longitudinally apart from and parallel to the arm member 15.

Behind the locking arm member 15 and between the protection walls 16, 16 is disposed a locking security member M1, having a gate shape base 17 and two flexible securing fingers 17a, 17a extending from the base along the opposite sides of the locking arm member 15. The base 17 has an unlocking preventing portion 17c provided in the main body of the locking securing member and enclosing the operating block portion 15c of the locking arm member 15 in an approximately similar place.

The flexible securing fingers 17a, 17a are formed on the lower surface connected with its free end 17a1 with a tapered driven surface 17a2 and an escape concave 17a3. The tapered surface 17a2 is formed with an engaging concave 17a4 inside its middle portion.

The locking arm member 15 is on opposite sides of the upright base 15a provided with engaging projection 18 having a front tapered surface 18a and a rear abutment surface 18b.

Figure 2A:
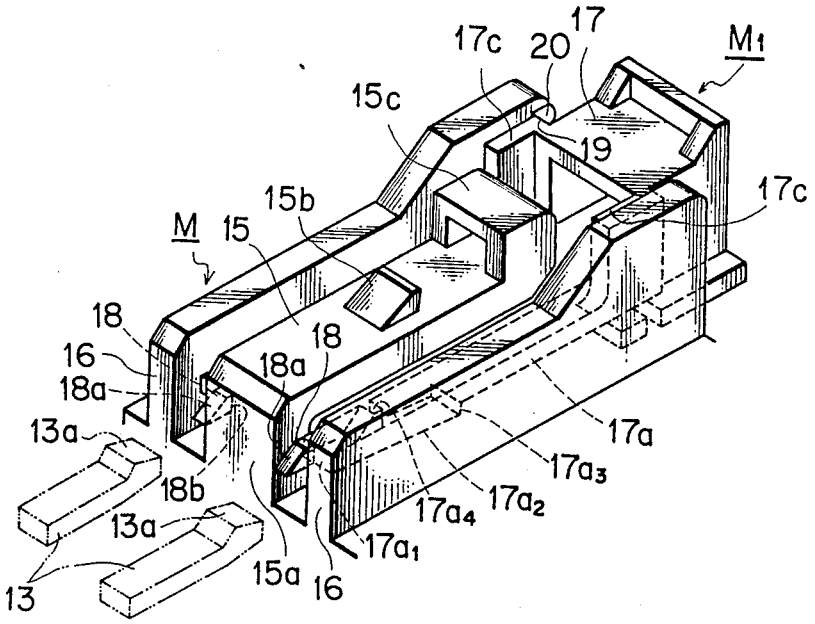
FIG. 2A, 2B is an enlarged perspective view of the male housing portion according to FIG. 1.
Figure 3A:
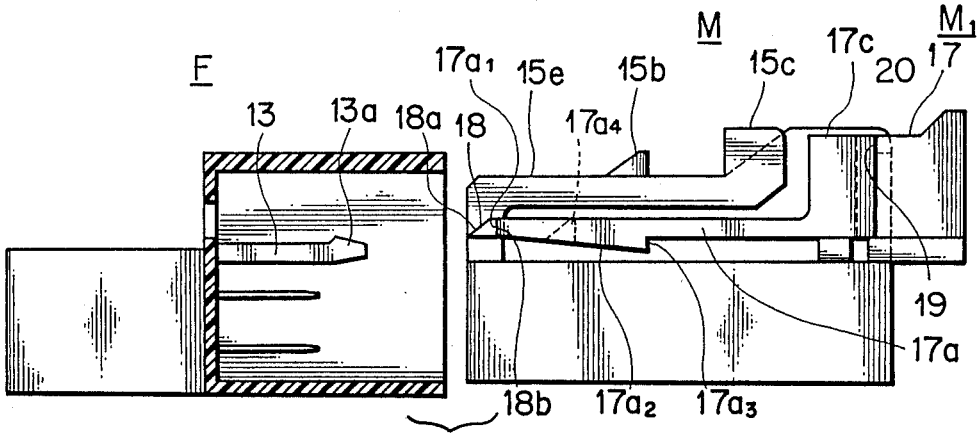
FIGS. 3A, 3B and 3C show the male and female housings in three respective positions of engaging steps, and among them FIG. 3A indicates the pre-engaging position of the lock security member before engagement, FIG. 3B the position at the time when the male and female housings are engaged and FIG. 3C that at the time when the lock security member is moved to the engaging position after engagement of housings.
Figure 3B:
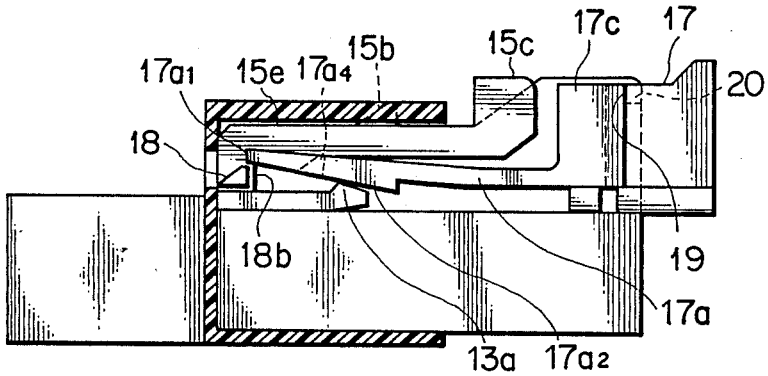

The lock security member M1 is urged to be inserted between the protection walls 16, 16 of the male connector member M from behind to engage a stepped portion 19 with a support protrusion 20 of the protection wall 16 which flexes temporally to allow the portion 19 passing when the free end 17a1 of the flexible securing fingers 17a, 17a abuts against an abutting surface 18b of the engaging projection 18. This is a pre-engaging position of the lock security member M1 (FIG. 2A, FIG. 3A). In such a state, when the male and female members M, F are engaged, the lug 15b of the locking arm member 15 is insertedly engaged with the locking opening 12b and the engagement unlocking actuating rod 13 provided within the female member F intrudes from the lower portion of the engagement projection 18 to the lower surface of the flexible securing fingers 17a, 17a thereby allowing the actuating projection 13a to raise the free end 17a1 of the flexible securing fingers 17a, 17a by means of the driven tapered surface 17a2 and remove it from the abutting surface 18b of the engaging projection 18 (see FIG. 3B).

Figure 2B:
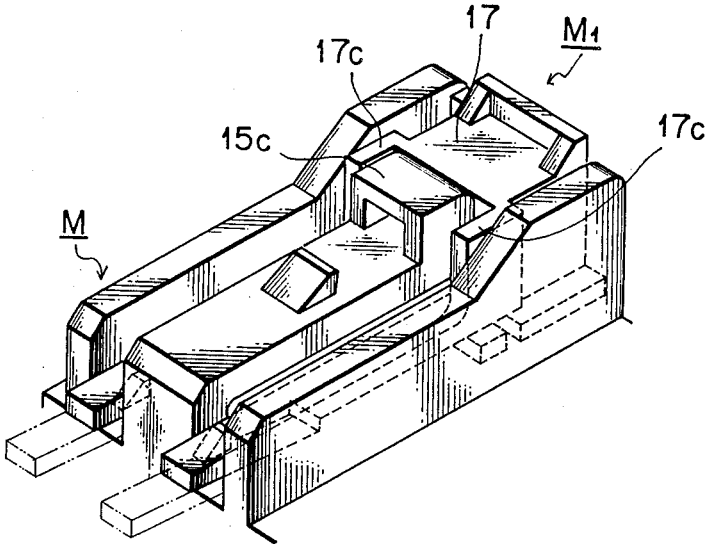
Figure 3C:
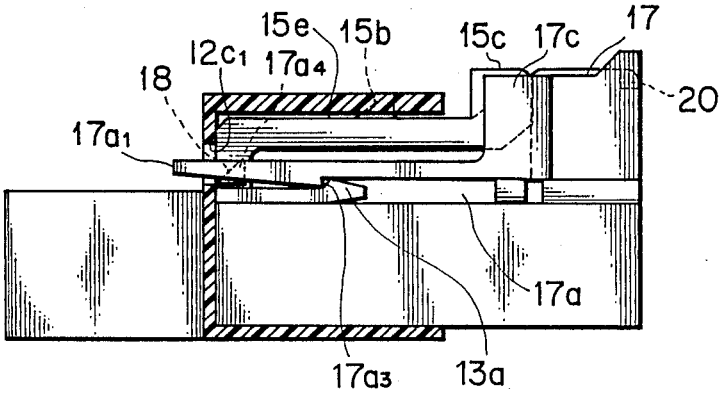

Next, if the locking security member M1 is further pushed, the flexible securing finger 17a is bent through the escape concave 17a3 when the lug 13a of the engagement unlocking actuating rod 13 passes the driven tapered surface 17a2, and the engaging concave 17a4 and the engaging projection 18 are engaged with each other to attain the main engagement in the main position (see FIG. 2B, FIG. 3C). The free end 17a1 of the fingers 17a projects through an opening 12c1 in the rear wall 12c of the female member front portion 12 and serves as disengagement means in case of unlocking. In this state, the base 17 or its unlocking preventing portion 17c comes near the position that it encloses the operating portion 15c of the locking arm member 15 which is prevented from an unintentional pushing-down by the operator's fingers or tools. The upper surface of unlocking preventing portion 17c is aligned with that of the base or main body 17, although it need not be so constructed. The arrangement for enclosing partially is available if it may substantially prevent the pushing-down of the operating portion 15c.

Figures 4, 5:
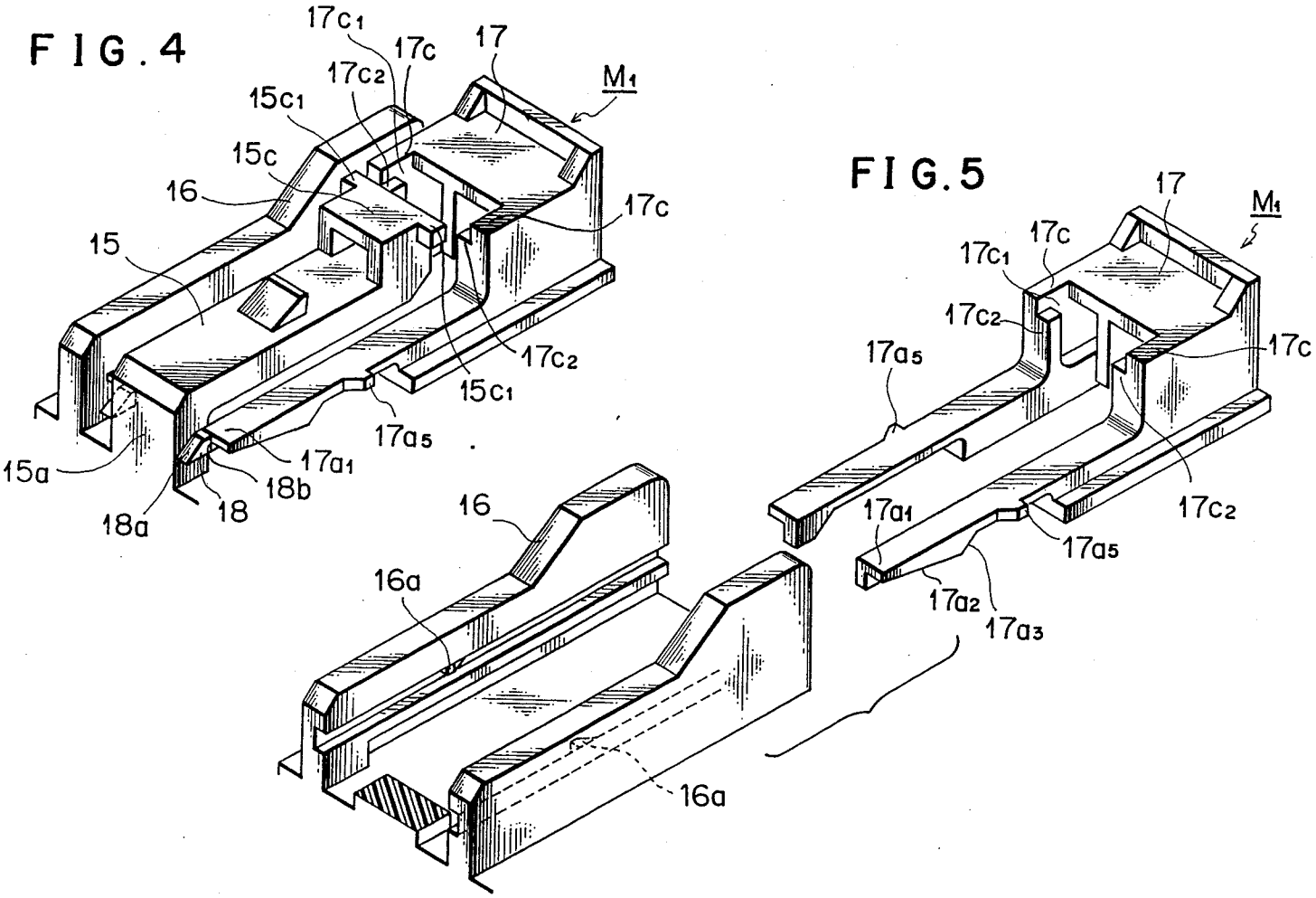
FIG. 4 is a perspective view of another embodiment of the invention in its main portion of the lock security member and the locking arm member.
FIG. 5 is a perspective view of still further embodiment of the invention in the main portion of the same members.
Figure 6:
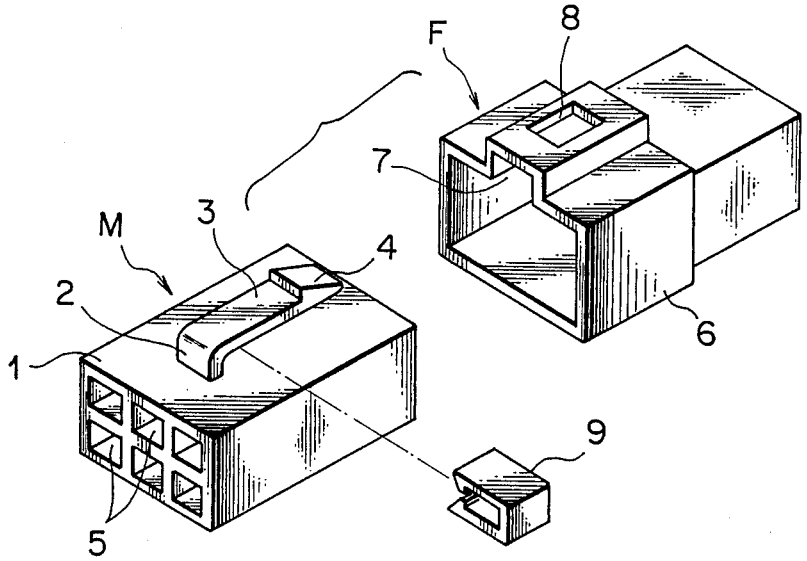
FIG. 6 PRIOR ART
FIG. 6 is a perspective view of a prior art mechanism in a disengaged state of housings.
Figure 7:
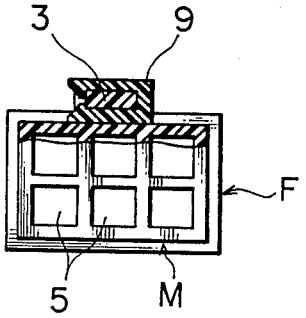
FIG. 7 PRIOR ART
FIG. 7 is a sectional view of the same showing the state of use.

In the embodiment of the invention as shown in FIG. 4 and 5, a lug 17a5 as the normal engagement means is provided on the side face of the flexible securing fingers 17a and when the locking security member M1, is disposed in the normal engagement position, the lug 17a5 engages with the normal engaging lug 16a formed in the interior of the protection wall 17a5.

Further, the locking arm 15 is provided with checking lugs 15c1, 15c1 on the opposite side faces of the operating block 15c and the unlocking operation preventing portion 17c is provided in the interior at the upper portion with checking lugs 17c2, 17c2 in a state that a space 17c1, 17c1 allowing the passing of the checking lug 15c1, 15c1 is provided. The checking lugs 17c2, 17c2 check the pushing-down of locking arm portion 15e when it is placed in incomplete engagement with respect to the locking securing member 17.

As described above, the lock security mechanism according to this invention has a lock security member for preventing the male and female housings from unlocking mounted on either of the housings in a pre-engaging state. Therefore, in the engagement operation, negligence or omission can not happen with ease in the engagement operation as much as would previously be possible due to incomplete engagement.

What is claimed is:

1. A locking security mechanism for an electrical connector having a pair of male and female connector members, the male member having a plurality of longitudinal compartments receiving terminal fittings and the female member having a rear portion having a plurality of longitudinal compartments corresponding to those of the male member and a front portion having a chamber for receiving at least a front portion of the male connector member, the locking security mechanism comprising:

lug means provided in one of the male and female connector members for locking the male and female connector members when engaged;

opening means provided in the other of the connector members for receiving the lug means; and locking security means for securing the locking of the male and female connector members, wherein the locking security means has a locking security member mounted in one of the connector members in a normally undetachable state and maintained in a pre-engagement position in which it is prevented from coming into a position for securing the locking of the lug means with the opening means, a pre-engagement releasing means provided in the other of the connector members for making the locking security member capable of coming into the position for securing the locking of the lug means with the opening means when the connector members are engaged, and a means for preventing the locking security member from coming into securing position when the lug means with the opening means is placed in an incomplete locking position.

2. A locking security mechanism for an electrical connector as set forth in claim 1 wherein said lug means includes a locking arm member provided in the outer wall of the male connector member with the lug means mounted thereon, and said opening means includes a locking opening provided in the outer wall of the front chamber portion of the female connector member for receiving the lug means on the locking arm member.

3. A locking security mechanism for an electrical connector as set forth in claim 2, wherein said locking security member has a main body positioned behind said locking arm member and having a locking security portion, and a longitudinal finger extending from the main body toward the front end of the male connector member and having a pre-engagement retaining portion.

4. A locking security mechanism for an electrical connector as set forth in claim 3, wherein the main body of said locking security member has an abutment contacting with an end face of the locking arm member when the locking security member comes into the locking security position to prevent the locking arm member from vertical flexing.

5. A locking security mechanism for an electrical connector as set forth in claim 3 or 4, wherein the main body of said locking security member has a shoulder abutting a lug provided in a portion extending from the male member for preventing the locking security member from detaching out of the male member.

6. A locking security mechanism for an electrical connector as set forth in claims 3 or 4 wherein said longitudinal finger has a tip end abutting to a pre-engagement retention lug provided at the front portion of the male member.

7. A locking security mechanism for an electrical connector as set forth in claim 6 wherein said locking security member having the longitudinal finger has a lower slant surface inclined rearwardly and downwardly, and co-acting with the pre-engagement releasing means allowing the tip end of the finger to escape from the pre-engagement retention lug.

8. A locking security mechanism for an electrical connector as set forth in claims 3 or 4 wherein said pre-engagement releasing means is a finger extending longitudinally from an interior rear wall of the male connector receiving chamber in the female member, and co-acting with the longitudinal finger of the locking security member.

9. A locking security mechanism for an electrical connector as set forth in claim 8, wherein the pre-engagement rleasing finger has a tip end of arrow-headed shape to co-act with the lower slant surface of the locking security member finger until the releasing finger engages with the locking security member finger.

10. A locking security mechanism for an electrical connector as set forth in claims 3 or 4 wherein said means for preventing the locking security member from securing a locking position includes a block member provided at a free end of the locking arm member, and an enclosure wall portion provided in the main body of the locking security member for receiving the block member of the locking arm member.

11. A locking securing mechanism for an electrical connector set forth in claim 10, wherein said means for preventing the locking security member from securing a locking position also includes checking lugs provided in the block member of the locking arm member and in the enclosure wall portion of the locking security member, the lugs of both members abutting each other.

12. A locking security mechanism for an electrical connector having a pair of male and female connector members wherein the male member has a plurality of longitudinal compartments receiving terminal fittings, the female member has a rear portion having a plurality of longitudinal compartments corresponding to those of the male member and a front portion having a chamber for receiving at least a front portion of the male connector member, the locking security mechanism comprising:

a locking arm member provided in the outer wall of the male connector member with lug means mounted on the locking arm member;

a locking opening provided in the outer wall of the front chamber portion of the female connector member for receiving the locking arm member and locking with the lug means; and locking security means, wherein the locking security means has a locking security member mounted in the male connector member in a normally detachable state and maintained in a pre-engagement position in which it is prevented from coming into a position for securing the locking of the locking arm member with the locking opening, a pre-engagement releasing means provided in the female connector member for making the locking security member capable of coming into the position for securing the locking of the locking arm member and locking opening are when the connector members are engaged, and a means for preventing the locking security member from coming into securing position when the locking arm member and locking opening are placed in a incomplete locking position, further the locking security member has a main body positioned behind said locking arm member and having a locking security portion, and a longitudinal finger extending from the main body toward the front end of the male connector member and having a pre-engagement retaining portion, the main body of said locking security member having an abutment contacting with the end face of the locking arm member when the locking security member comes into the locking security position to prevent the locking arm member from vertical flexing.

13. A locking security mechanism for an electrical connector as set forth in claim 12 wherein the main body of said locking security member has a shoulder abutting a lug provided in a portion extending from the male connector member for preventing the locking security member from detaching out of the male connector member.

14. A locking security mechanism for an electrical connector as set forth in claim 12 wherein said longitudinal finger has a tip and abutting to a pre-engagement retention lug provided at the front portion of the male connector member.

15. A locking security mechanism for an electrical connector set forth in claim 14 wherein said locking security member having the longitudinal finger has a lower slant surface inclined rearwardly and downwardly, and co-acting with the pre-engagement releasing means allowing a tip end of the finger to escape from the pre-engagement retention lug.

16. A locking security mechanism for an electrical connector as set forth in claim 12 wherein said means for preventing the locking security member from securing a locking position includes a block member at a free end of the locking arm member and an enclosure wall portion provided in the main body of the locking security member for receiving the block member of the locking arm member.

17. A locking securing mechanism for an electrical connector set forth in claim 16, wherein said means for preventing the locking security member from securing a locking position also includes checking lugs provided in the block member of the locking arm member and in the enclosure wall portion of the locking security member, the lugs of both members abutting each other.

* * * * *